US005727786A

United States Patent [19]

Weingardt

[11] Patent Number: 5,727,786

[45] Date of Patent: Mar. 17, 1998

[54] BINGO GAME METHOD

[76] Inventor: Gary Weingardt, 1707 Comstock Dr., Henderson, Nev. 89014

[21] Appl. No.: 569,793

[22] Filed: Dec. 8, 1995

Related U.S. Application Data

[63] Continuation-in-part of Ser. No. 182,850, Jan. 18, 1994, Pat. No. 5,482,289, and Ser. No. 366,982, Dec. 29, 1994, abandoned.

[51] Int. Cl.[6] ..... A63F 3/06

[52] U.S. Cl. ..... 273/269; 273/274

[58] Field of Search ..... 273/269, 270, 273/274, 148 R, 292

[56] References Cited

U.S. PATENT DOCUMENTS

| | | | |
|---|---|---|---|
| 1,655,380 | 1/1928 | Parker . | |
| 4,019,744 | 4/1977 | Pizur, Sr. | 273/135 |
| 5,029,871 | 7/1991 | Wilson, Jr. et al. | 273/271 |
| 5,127,656 | 7/1992 | Simpson | 273/269 |
| 5,160,146 | 11/1992 | Greer | 273/269 |
| 5,351,970 | 10/1994 | Fioretti | 273/439 |
| 5,569,083 | 10/1996 | Fioretti | 463/19 |

OTHER PUBLICATIONS

Scarne's Complete Guide to Gambling, pp. 182–199 and 432–441, copyright 1961.

Scarne's New Complete Guide to Gambling, pp. 205–223, copyright 1974.

*Primary Examiner*—William M. Pierce

*Attorney, Agent, or Firm*—John Edward Roethel

[57] ABSTRACT

All of the possible bingo numbers are displayed on an electronic reader board in the bingo game room. At the beginning of each game, an electronic random number generator selects a predetermined group of bingo numbers to be "blue" numbers, "green" numbers and "red" numbers. All of the other remaining numbers are "yellow" numbers for that particular game of bingo. When a player achieves a bingo, the player wins certain preestablished payouts depending upon whether the player has an all "blue" bingo, an all "green" bingo, an all "red" bingo, an all "yellow" bingo or any other bingo (which would be a "mixed color" bingo). The all "blue" bingo receives the highest payout, the all "green" bingo receives the next highest payout, the all "red" bingo receives the next highest payout, the all "yellow" bingo receives the next highest payout and the smallest payout is awarded to a regular "mixed color" bingo. A progressive feature can be added to the method of play of bingo in which the player makes a separate, additional wager to be eligible for the progressive jackpot payouts. Progressive jackpot pools can be established for an all "blue" bingo, an all "green" bingo, an all "red" bingo, an all "yellow" bingo or even for a "case" bingo. "Case" bingos are those in which a player has missed a bingo by one number. The "case" bingo is a "near miss" bingo and a jackpot pool can be used to pay those players who almost won.

41 Claims, 9 Drawing Sheets

BINGO GAME METHOD

CROSS-REFERENCE TO RELATED APPLICATIONS

This application is a Continuation-in-Part of application Ser. No. 08/182,850, filed Jan. 18, 1994, entitled "Bingo Game", now U.S. Pat. No. 5,482,289 and a Continuation-in-Part of application Ser. No. 08/366,982, filed Dec. 29, 1994, entitled "Bingo Game", now abandoned.

BACKGROUND OF THE INVENTION

This invention relates to a bingo game, and more particularly to a bingo game that utilizes progressive jackpot pools and increases the attractiveness of the game to the players.

Conventional bingo is a well known game. Players are provided with bingo cards that have a matrix of five rows and five columns. The columns are lettered B I N G O from left to right across the top of the matrix and each bingo card has five numbers in each row except the center I column which has a "free space" at the intersection of the third row and the third column.

Bingo balls individually numbered 1–75 are mixed together and balls are selected one at a time. As each ball is selected, the number is announced to the players, who cover any corresponding number on their bingo card. When a player achieves a predetermined arrangement of covered spots on his bingo card, that player yells out "Bingo!" and he wins he game.

In the conventional manner of play of bingo, in order to win the game, a player must cover five spaces in a vertical column, a horizontal row or along one of the two diagonals of the bingo card. The free space in the center of the bingo card allows a player to win with as few as four numbers being drawn. Other winning combinations include the four corners of the bingo card and the eight numbers immediately adjacent and surrounding the free space. Winning combinations can also include the covering of spots on the bingo card so that letter symbols are formed such as an X, U, L, H or T.

The operator of the bingo game will designate at the beginning of the game which particular combination or combinations of covered spots will be winning combinations for that particular game. It is also popular to play "coverall" or "blackout" games in which all of the spots on the bingo card must be covered (the twenty-four spots having numbers and the center free space) in order for the player to win.

Bingo can be played as an amusement game, but it is quite popular as a form of gambling. Players purchase bingo cards for use during the bingo session and winning players receive payouts from the operator or gaming establishment. Typically, a bingo session includes a number of individual bingo games concluding with a coverall game in which a large prize is awarded. Some operators also offer a jackpot prize if the coverall is achieved within a fixed number of called numbers, e.g. 50.

It is also known to add an extra colored bingo ball to the seventy-five numbered balls. The colored ball acts as a wild card or wild number and, if this colored ball is drawn, a player may cover any number he chooses on the bingo card.

Two variations are played of the standard bingo that uses seventy-five numbers and a five-by-five matrix bingo card. One variation is known as Lightning Bingo or Speed Bingo, and is quite popular in Indian reservations. In Lightning or Speed Bingo, there is a pool of thirty numbers, e.g. balls numbered 1–30 without letter designations. Each player has a bingo card with only three numbers thereon, generally set out in a horizontal pattern. In Lightning Bingo, the caller draws numbers sequentially from the pool of thirty numbers and a player wins when he achieves all three numbers called on his bingo card.

The other variation is known as English Bingo and is generally played in England and other parts of Europe as well as on other continents. In English Bingo, there is a pool of ninety numbers, e.g. balls numbered 1–90 without letter designations. Each player has a bingo card with multiple horizontal rows, each row having five numbers therein with the rest of the row comprising one or more blank (free) spaces. In English Bingo, the caller draws numbers sequentially from the pool of ninety numbers and a player wins when he achieves all five numbers called on a single row of his bingo card.

Conventional bingo has remained relatively unchanged for many years. As legalized gaming expands into more and more jurisdictions and as Indian gaming becomes more widespread, there is a need to increase the attractiveness of bingo in order to interest more players to participate in the game.

In relative terms, bingo as it is currently conducted in gaming casinos is a low payout game. During each bingo game, numbers are drawn until a player wins, so the gaming establishment is limited in the amount of money it can award as prizes. During a regular bingo game in which the winning bingo combination is simply five covered spots in a row vertically, diagonally or horizontally, a winning player can expect to receive a $500.00 payout. The jackpot coverall game at the end of a session may pay out $1,000.00 to the winning player. If a typical bingo session has ten regular games and a single jackpot coverall game, the gaming establishment has guaranteed to pay out $6,000.00 to the players.

The revenue to the gaming establishment is based on the number of bingo cards that are bought by the players. Since the prize fund is guaranteed at a fixed amount, the more bingo cards a gaming establishment can sell, the better the profit will be.

Bingo operators have attempted to increase interest in bingo by paying larger jackpot payouts for coveralls achieved in a predetermined number of selected numbers. It takes at least twenty-four drawn numbers to achieve a coverall and typically most bingo operators select a number between fifty and fifty-five as the number of balls in which the coverall is achieved in order for the player to win the large jackpot, say $5,000.00. If a coverall is not achieved within this preset number requirement, then the payout reverts to the smaller jackpot amount, say $1,000.00, for the player who achieves the coverall.

With the advent of electronic bingo, players are able to play virtually an unlimited number of bingo cards, thus increasing their chances of hitting a bingo. With all the positive aspects of electronic bingo, it is still limited in the size and amount of the payouts that can be made since there is a cap on the total of bingo ball numbers (seventy-five) available to be chosen and a limited number of locations to hit these numbers (24 spaces). These limitations along with the free space greatly affect the amount of the jackpot prize that can currently be awarded.

There is a need to increase the player appeal of bingo in order to generate increased revenues from the operation of the game. Increased player participation would allow the payment of higher payouts which in turn would generate more player participation.

It is an object of the present invention to provide a method of playing bingo and an improved bingo apparatus that will increase the player participation in the game.

It is a further object of the present invention to increase the popularity of bingo by increasing the difficulty factor of getting a bingo, to allow for prizes high enough to attract gamblers away from other types of gaming such as video poker, slot machines and live table games, and to compete with lotteries.

It is a feature of the present invention to provide a large electronic display board on which all of the possible bingo ball numbers are displayed. Prior to each game, some of the numbers on the display board are specially designated with a first distinctive marking and a smaller portion of the numbers on the display board are specially designated with a second distinctive marking. These special designations are accomplished by means of an electronic random number generator so that chance is introduced into the selection of which numbers receive the first distinctive marking and the second distinctive marking.

It is a further feature of the present invention to provide a progressive jackpot feature to the game of bingo in which the player can become eligible for the progressive jackpot by making a separate wager.

It is an advantage of the present invention that the additional features added to the bingo game will allow more payouts to be made by the gaming establishment or the bingo operator. This will result in increased player participation and additional revenues to the gaming establishment or bingo operator.

Other objects, features and advantages of the present invention will become apparent from a consideration of the following detailed description.

SUMMARY OF THE INVENTION

All of the possible bingo numbers are displayed on an electronic reader board in the bingo game room. At the beginning of each game, an electronic random number generator selects a predetermined group of bingo numbers to be "blue" numbers for that particular game. Additionally, the electronic number generator also selects a slightly larger predetermined group of bingo numbers to be "green" numbers for that same particular game. Still additionally, the electronic number generator also selects a still larger predetermined group of bingo numbers to be "red" numbers for that same particular game. All of the other remaining numbers are "yellow" numbers for that particular game of bingo.

When a player achieves a bingo, the player wins certain preestablished payouts depending upon whether the player has an all "blue" bingo, an all "green" bingo, an all "red" bingo, an all "yellow" bingo or any other bingo (which would be a "mixed color" bingo). The all "blue" bingo receives the highest payout, the all "green" bingo receives the next highest payout, the all "red" bingo receives the next highest payout, the all "yellow" bingo receives the next highest payout and the smallest payout is awarded to a regular "mixed color" bingo.

A progressive feature can be added to the method of play of bingo in which the player makes a separate, additional wager to be eligible for the progressive jackpot payouts. Progressive jackpot pools can be established for an all "blue" bingo, an all "green" bingo, an all "red" bingo, an all "yellow" bingo or even for a "case bingo". "Case" bingos are those in which a player has missed a bingo by one number. The "case" bingo is a "near miss" bingo and a jackpot pool can be used to pay those players who almost won.

DETAILED DESCRIPTION OF THE PREFERRED EMBODIMENTS

Figure 1:
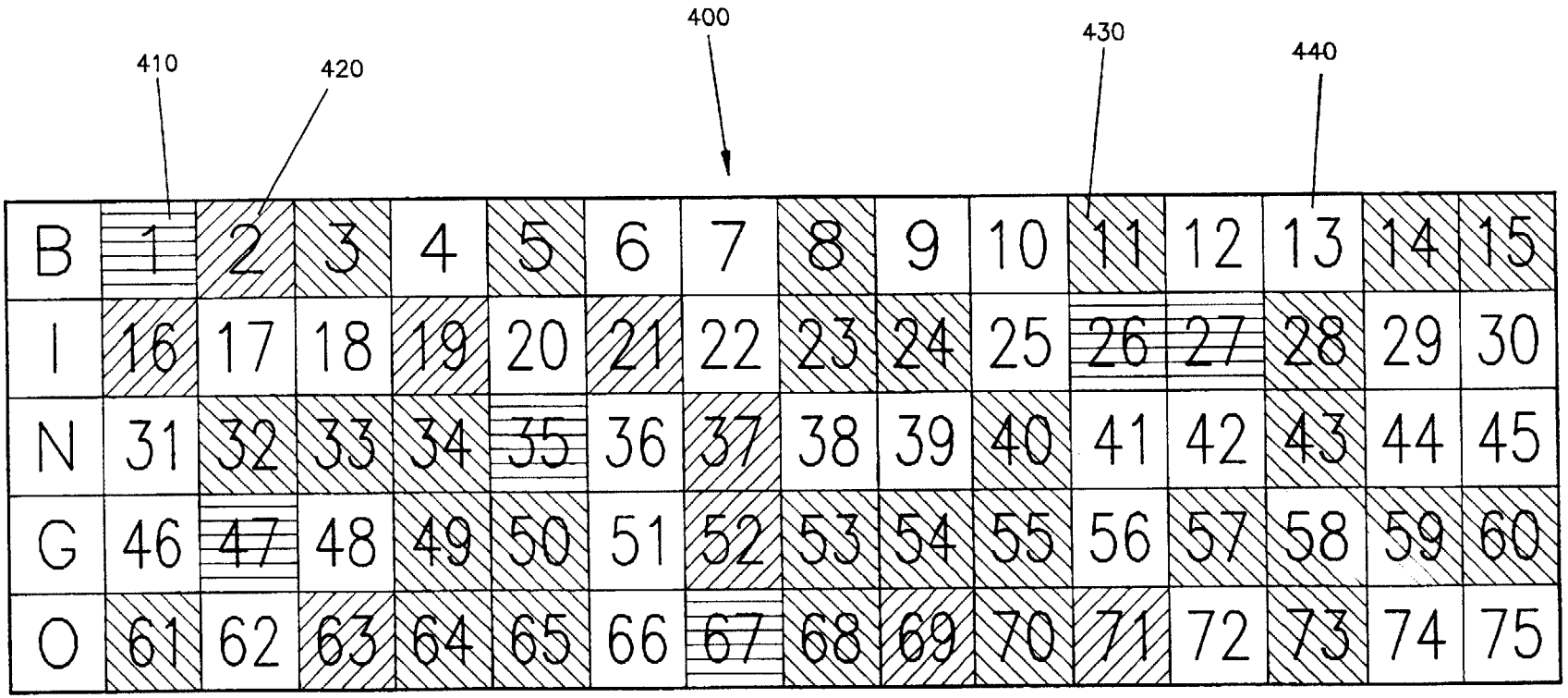
FIG. 1 shows an electronic bingo number display board programmed to show each game which bingo numbers have been selected as the "blue" numbers, the "green" numbers, the "red" numbers and which bingo numbers remain as the "yellow" numbers.

FIG. 1 shows the electronic bingo number display board 400 that is used in the room or hall in which the bingo game is being conducted. The display board 400 is modeled after a conventional electronic bingo display board used in seventy-five number bingo in that there are five rows designated B, I, N, G and O, with each row having the fifteen numbers that comprise a conventional seventy-five number bingo set.

The electronic controls that operate this bingo board 400 include a conventional random number generator that is programmed to randomly select from the seventy-five number set three groups of bingo numbers to be designated as the first specially designated numbers, the second specially designated numbers and the third specially designated numbers for a particular game. All numbers not selected remain with their original designation on the bingo board 400 and are considered the fourth group of specially designated numbers.

In the preferred embodiment of the present invention, a total of between four and eight of the bingo numbers, and in the most preferred embodiment six numbers, are predetermined each game to be the "blue" numbers (the first specially designated numbers). A total of between nine and fifteen of the bingo numbers, and in the most preferred embodiment ten numbers, are predetermined to be the "green" numbers (the second specially designated numbers). A total of between sixteen and thirty-five of the bingo numbers, and in the most preferred embodiment twenty-seven numbers, are predetermined to be the "red" numbers (the third specially designated numbers). Whatever numbers are remaining are left as "yellow" numbers, which in the most preferred embodiment would be thirty-two numbers (the fourth specially designated numbers).

For example, as shown in FIG. 1, six numbers have been designated as "blue" numbers 410, ten numbers are designated as "green" numbers 420 and twenty-seven numbers have been designated as "red" numbers 430. The remaining thirty-two bingo numbers are left as "yellow" or regular numbers 440.

Of course, there is nothing critical about the use of "blue", "green", "red" and "yellow" as the designators for the numbers on the electronic reader board 400. Any suitable markings can be used, as long as the players can differentiate between the markings on the reader board 400. For example, depending on the type of electronic reader board that is being used, it may be easier to use letters or other character symbols as the markings used to designate the various numbers, especially if a monochromatic reader board is used.

The electronic controls that operate the electronic bingo board illuminate the selected "blue" numbers as the color "blue", the selected "green" numbers as the color "green" and the selected "red" numbers as the color red. The remaining numbers are left as "yellow" which is the initial color of all the numbers on the electronic reader board. Each player can then see at the beginning of a game which of the bingo numbers have the various distinctive markings.

The game then begins in the conventional manner with the bingo caller announcing which bingo numbers have been selected sequentially during the play of the game. As soon as a player achieves a BINGO, the player calls this out and a determination is made as to whether the player has achieved a regular bingo or one of the special bingos that can be achieved. The amount of the prize that the player wins depends on the color markings on the reader board of the numbers that the player used to achieve a BINGO.

If the player has a BINGO in which all of his winning numbers are "blue" numbers, then the player can be paid a large first award. If the player has a BINGO in which all of his winning numbers are "green" numbers, then the player can be paid a second award. If the player has a BINGO in which all of his winning numbers are "red" numbers, then the player can be paid a third award. If the player has a bingo in which all of his winning numbers are just "yellow" numbers, then the player can be paid a fourth award. Finally if the player has a bingo in which all of his winning numbers include two or more of the colors (a "mixed color" bingo), then the player can be paid a fifth award, which would be the smallest award.

Because the identification of the "blue", "green", "red" and "yellow" bingo numbers are made on the electronic reader board, it is possible to use any type of bingo card to play the method of the present invention. Hard board cards or paper cards can be used by the players and it is not necessary to have specially printed cards used for the game. Even electronic bingo stations that are now in use at which each player sits and electronically participates in the game can be used. The only modification that a bingo establishment needs to undertake to practice the method of the present invention is to install the electronic reader board that can show different designations on the numbers on the board as well as a random number generator to predetermine which numbers are going to have which designations for that particular game.

While the preferred embodiment of the present invention uses four designated markings for the bingo numbers, it is possible to practice the method of the present invention using as few as two or three designated markings or more than four designated markings.

Figure 2:
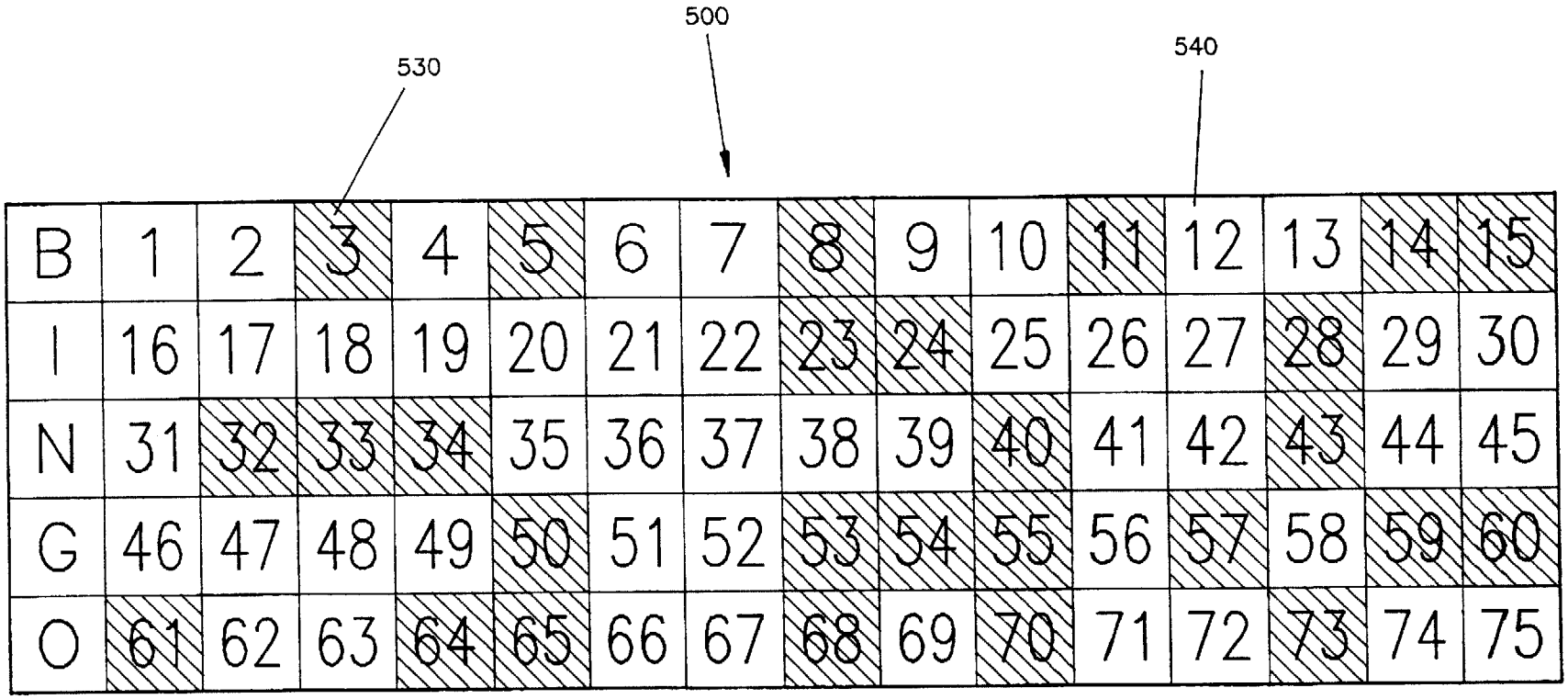
FIG. 2 shows an alternative electronic bingo number display board programmed to show each game which bingo numbers have been selected as the "red" numbers and which bingo numbers remain as the "yellow" numbers.

For example, FIG. 2 shows the electronic bingo number display board 500 that is operated by the electronic controls so that the conventional random number generator randomly select from the seventy-five number set one group of bingo numbers to be designated as the first specially designated numbers. All numbers not selected remain with their original designation on the bingo board 500 and are considered the second group of specially designated numbers.

In this preferred embodiment of the present invention, a total of between sixteen and thirty-five of the bingo numbers, and in the most preferred embodiment twenty-seven numbers, are predetermined to be the "red" numbers (the first specially designated numbers). Whatever numbers are remaining are left as "yellow" numbers, which in the most preferred embodiment would be forty-eight numbers (the second specially designated numbers).

For example, as shown in FIG. 2, twenty-seven numbers have been designated as "red" numbers 530. The remaining forty-eight bingo numbers are left as "yellow" or regular numbers 540.

The amount of the prize that the player wins depends on the color markings on the reader board of the numbers that the player used to achieve a BINGO.

If the player has a BINGO in which all of his winning numbers are "red" numbers, then the player can be paid a large first award. If the player has a BINGO in which all of his winning numbers are "yellow" numbers, then the player can be paid a second award, if the gaming establishment chooses to provide more than one award. Finally if the player has a bingo in which all of his winning numbers include two or more of the colors (a "mixed color" bingo), then the player can be paid a third award, which would be the smallest award.

Figure 3:
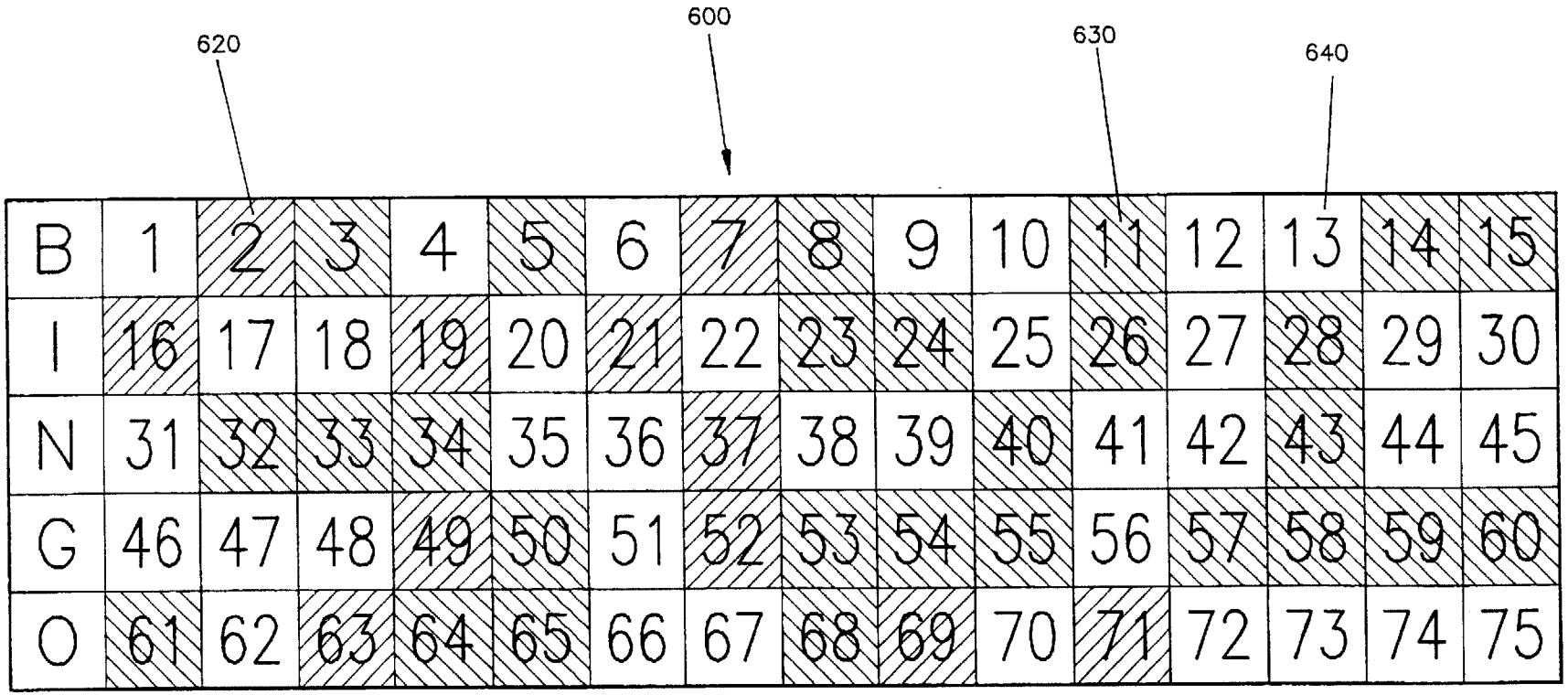
FIG. 3 shows yet another electronic bingo number display board programmed to show each game which bingo numbers have been selected as the "green" numbers and the "red" numbers and which bingo numbers remain as the "yellow" numbers.

Again, by way of example, FIG. 3 shows the electronic bingo number display board 600 that is operated by the electronic controls so that the conventional random number generator randomly select from the seventy-five number set two groups of bingo numbers to be designated as the first specially designated numbers and the second specially designated numbers. All numbers not selected remain with their original designation on the bingo board 600 and are considered the third group of specially designated numbers.

In this preferred embodiment of the present invention, a total of between nine and fifteen of the bingo numbers, and in the most preferred embodiment ten numbers, are predetermined to be the "green" numbers (the first specially designated numbers). A total of between sixteen and thirty-five of the bingo numbers, and in the most preferred embodiment twenty-seven numbers, are predetermined to be the "red" numbers (the second specially designated numbers). Whatever numbers are remaining are left as "yellow" numbers, which in the most preferred embodiment would be thirty-eight numbers (the third specially designated numbers).

For example, as shown in FIG. 3, ten numbers have been designated as "green" numbers 620 and twenty-seven numbers have been designated as "red" numbers 630. The remaining thirty-eight bingo numbers are left as "yellow" or regular numbers 640.

The amount of the prize that the player wins depends on the color markings on the reader board of the numbers that the player used to achieve a BINGO.

If the player has a BINGO in which all of his winning numbers are "green" numbers, then the player can be paid a large first award. If the player has a BINGO in which all of his winning numbers are "red" numbers, then the player can be paid a second award. If the player has a BINGO in which all of his winning numbers are "yellow" numbers, then the player can be paid a third award. Finally if the player has a bingo in which all of his winning numbers include two or more of the colors (a "mixed color" bingo), then the player can be paid a fourth award, which would be the smallest award.

If it is desired to expand the designated markings beyond the four markings used in the preferred embodiment of the present invention, this can be done by adding additional designated colors and randomly selecting these colors at the beginning of each game. Based on the mathematical calculations that can be made of the odds of various types of colored BINGO's being achieved, the relative distribution of the number of various colors used can be determined based on the frequency of achieving the various bingo combinations.

The size of the awards to the players for the various "one color" bingos or the "mixed color" bingos can be determined by the gaming establishment. In one embodiment of the present invention, these awards can be fixed amounts.

Alternatively, progressive jackpot pools may be established so that the amount of the award increases over time and this will increase the attractiveness of the game to the players. The funding for these progressive jackpot pools can come from the regular buy-in to play the game or a separate buy-in can be created. In this embodiment, a first wager is made to play the regular bingo game and a second wager is required from a player to be eligible to win one of the progressive jackpot pools. If the player has the option of making this second wager, a player will be paid a conventional payout for achieving a bingo. Then, if the player has also made the second wager to be eligible for the progressive jackpot pools, that same player will receive a second payout if the player has achieved one of the predetermined progressive jackpot pool winning combinations.

The progressive pools used with the electronic reader board version of the present invention can take any suitable format. For example, separate progressive pools can be created for an all "blue" bingo, an all "green" bingo, an all "red" bingo and an all "yellow" bingo.

In this embodiment, all progressive money is pooled together and distributed amongst the various progressive jackpot pools and the gaming establishment. A portion of this progressive money can also be designated as seed money for re-seeding each pool after a player wins the pool. This avoids having a progressive pool go back to zero, which would discourage player participation.

In one preferred embodiment of the present invention, the progressive wager money could be divided with 10% going to the "all blue" pool and another 4% going to the seed pool for the "all blue" pool, 10% going to the "all green" pool and another 4% going to the seed pool for the "all green" pool, 14% going to the "all red" pool and another 7% going to the seed pool for the "all red" pool, 14% going to the "all yellow" pool and another 7% going to the seed pool for the "all yellow" pool and the remaining 30% being held by the bingo establishment.

When the progressive jackpots reach high amounts, players may wager large amounts to increase their chances of winning. These large wagers may be in excess of what the house offers as the non-progressive standard bingo payout prize. Therefore, in such a situation there may need to be a mechanism which would allow the house to increase the standard bingo payout prize in proportion to the amounts wagered. This mechanism can be found in U.S. Pat. No. 5,275,400 (Weingardt), incorporated herein by this reference.

Furthermore, another payout pool can be established to pay any player who achieves a "case bingo." A "case bingo" is achieved whenever a player is one number short of having a pre-established winning bingo arrangement. The "case bingo" winners are determined after a winning bingo arrangement occurs during a particular round of play and the "case bingo" payout pool is split up among those players qualifying with "case bingos."

Alternatively, one large progressive pool can be established and various flat amounts or percentages of this pool can be paid to a player who achieves one of the predetermined bingo combinations.

Figure 4:
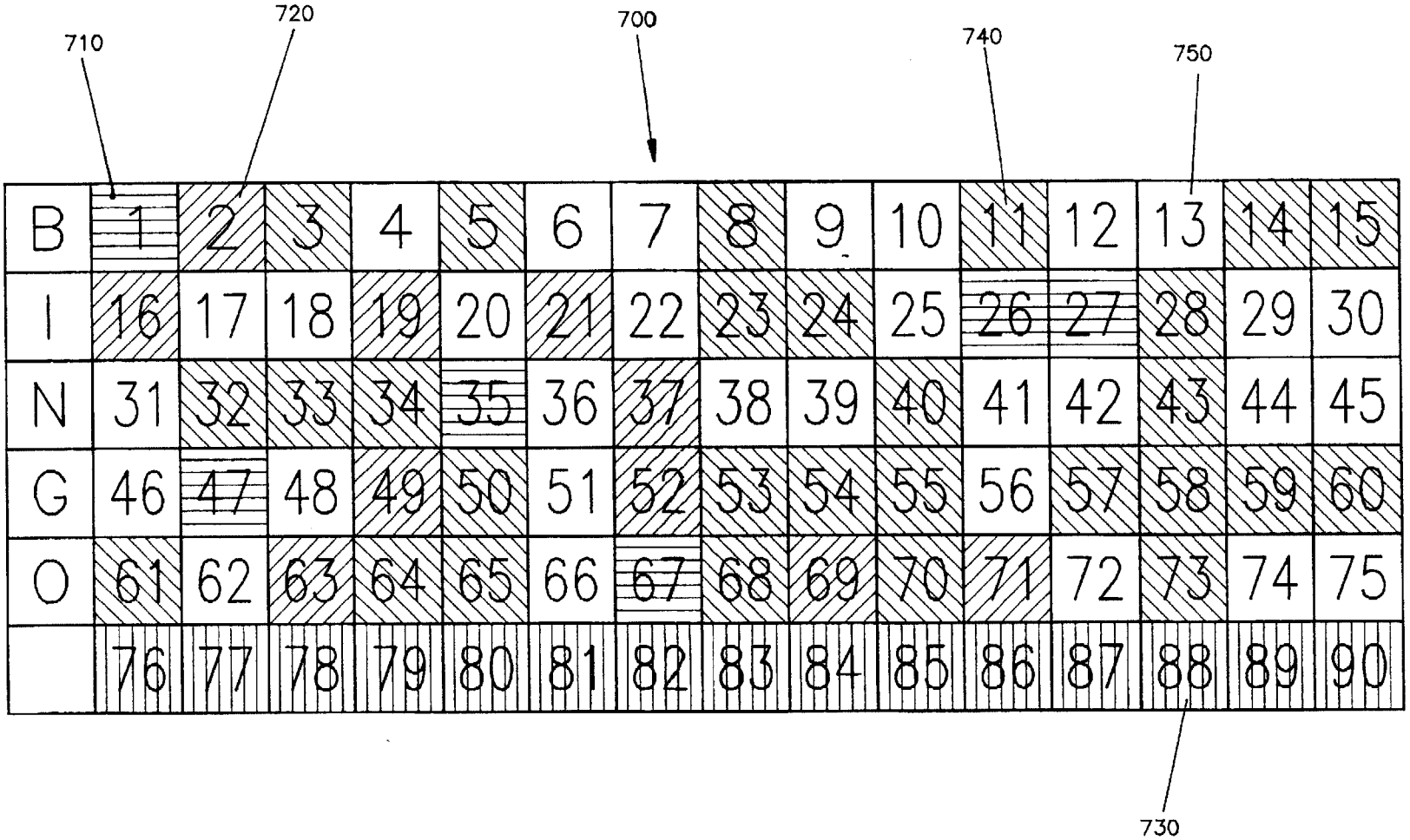
FIG. 4 shows an electronic bingo number display board used in a form of English Bingo played in accordance with the method of the present invention.
Figure 5A:
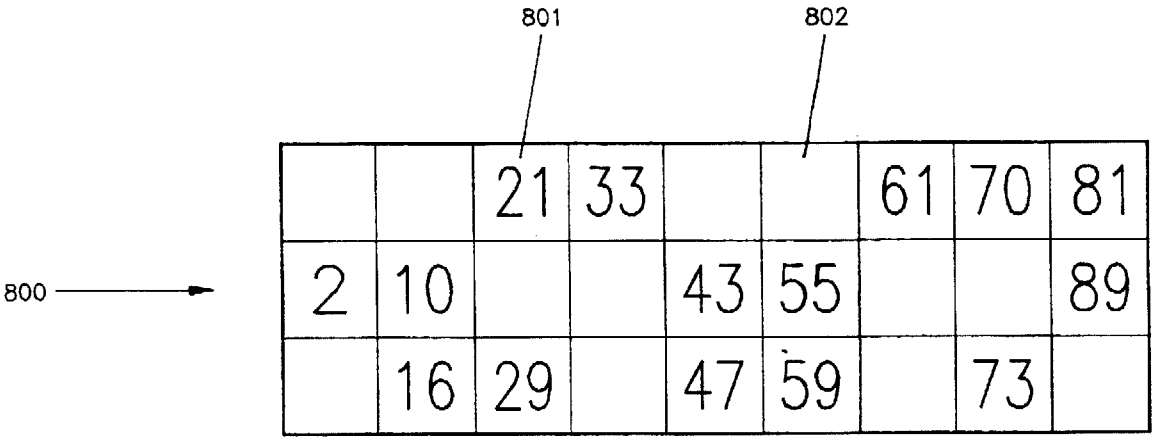
FIG. 5A shows a representative bingo card used in the play of English Bingo in accordance with the method of the present invention.
Figure 5B:
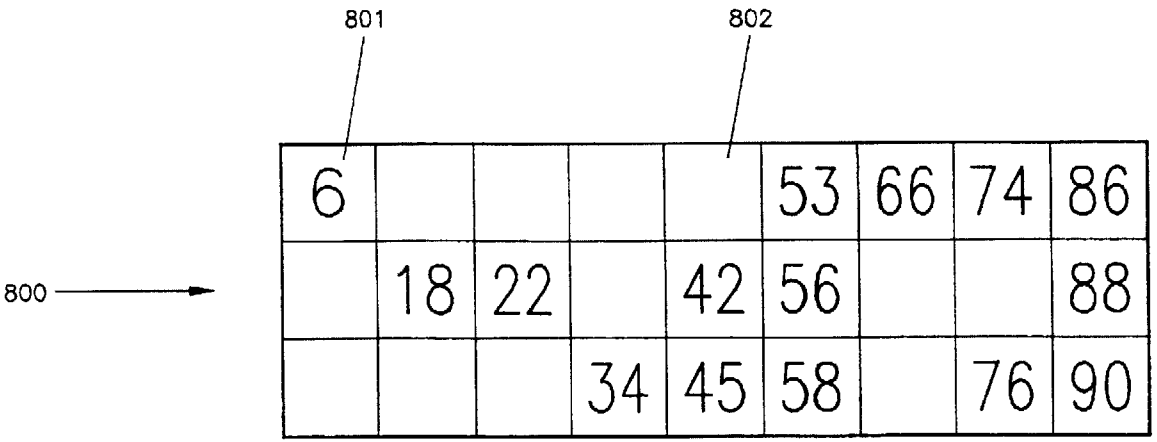
FIG. 5B shows another representative bingo card used in the play of English Bingo in accordance with the method of the present invention.

The method of the present invention can also be applied to a form of bingo known as English Bingo. In English Bingo, there is a pool of ninety numbers, e.g. balls numbered 1–90. FIG. 4 shows the reader board pattern 700 for an English Bingo game and FIGS. 5A and 5B each shows a representative bingo card 800 used in English Bingo. Each player has a bingo card with one or more horizontal rows, each row having only five numbers 801 therein and one or more blank (free spaces) 802.

In English Bingo, the caller draws numbers sequentially from the pool of ninety numbers and a player wins when he achieves all five numbers called on a single row of his bingo card.

Similarly to the invention described above in connection with FIGS. 1–3, the electronic reader board 700 for English Bingo uses a random number generator to designate some of the ninety numbers as "blue" numbers 710, some as "green" numbers 720, some as "black" numbers 730, some as "red" numbers 740 and the remaining numbers are left as "yellow" or natural numbers 750.

The progressive pools used with the electronic reader board version of English Bingo can take any suitable format and can be similar in format and use as described above in connection with FIGS. 1–3. For example, separate progressive pools can be created for all "black" bingos, all "blue" bingos, all "green" bingos, all "red" bingos and all "yellow" bingos. Alternatively, there may only be a single progressive pool for just one of the "color" bingos.

The funding for the English Bingo progressive jackpots can come from the pool of money used as the buy-in for the regular game or from a separate wager or buy-in required from a player to be eligible for the progressive jackpots. The money can also be used to form the seed pools for re-seeding each pool after a player wins the pool.

Figure 6A:
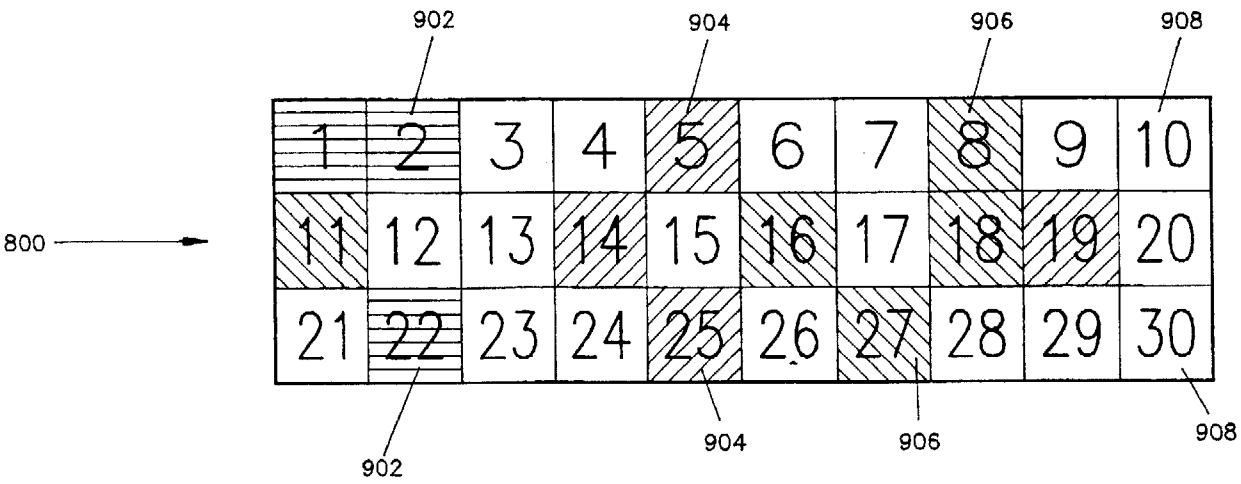
FIG. 6A shows an electronic bingo number display board used in a form of Lightning Bingo played in accordance with the method of the present invention.
Figure 6B:
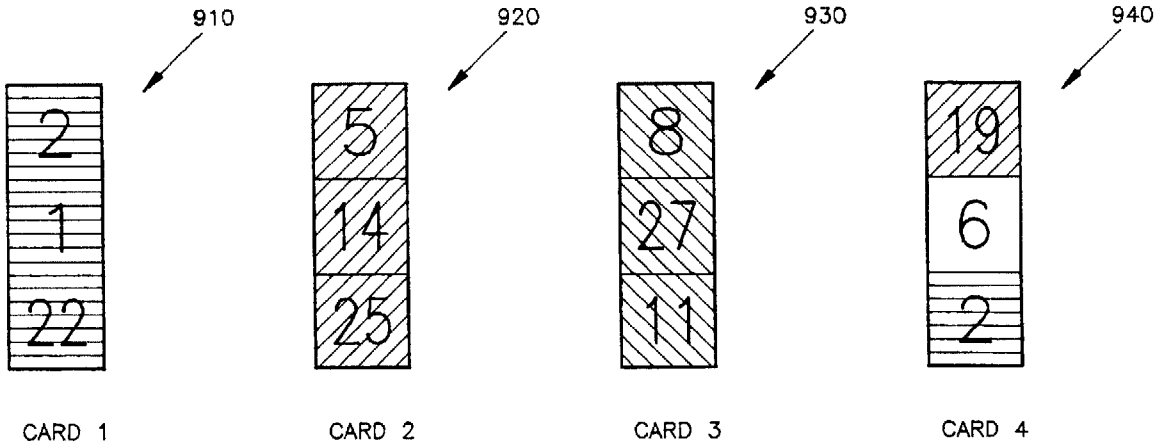
FIG. 6B shows three representative bingo cards used in the play of Lightning Bingo in accordance with the method of the present invention.

The method of the present invention can also be applied to a form of bingo known as Lightning Bingo or Speed Bingo. In Lightning or Speed Bingo, there is a pool of thirty numbers, e.g. balls numbered 1–30 without letter designations. Each player has a bingo card with only three numbers thereon, generally set out in a vertical pattern. FIG. 6A shows the electronic reader board pattern 900 for a Lightning Bingo game and FIG. 6B shows four representative bingo cards 910, 920, 930 and 940 used in Lightning Bingo.

In Lightning Bingo, the caller draws numbers sequentially from the pool of thirty numbers and a player wins when he achieves all three numbers called on his bingo card.

Similarly to the invention described above in connection with FIGS. 1–4, the electronic reader board 900 for Lightning Bingo uses a random number generator to designate some of the thirty numbers as "blue" numbers 902, some of the other thirty numbers as "green" numbers 904 and some of the thirty numbers as "red" numbers 906. The remaining numbers are left as "yellow" or natural numbers 908.

The progressive pools used with the electronic reader board version of Lightning Bingo can take any suitable format and can be similar in format and use as described above in connection with FIGS. 1–4. For example, separate progressive pools can be created for "all blue" bingos, "all green" bingos and "all yellow" bingos. Alternatively, there may only be a single progressive pool.

The funding for the Lightning Bingo progressive jackpots can come from the pool of money used as the buy-in for the regular game or from a separate wager or buy-in required from a player to be eligible for the progressive jackpots. The money can also be used to form the seed pools for re-seeding each pool after a player wins the pool.

Figure 7:
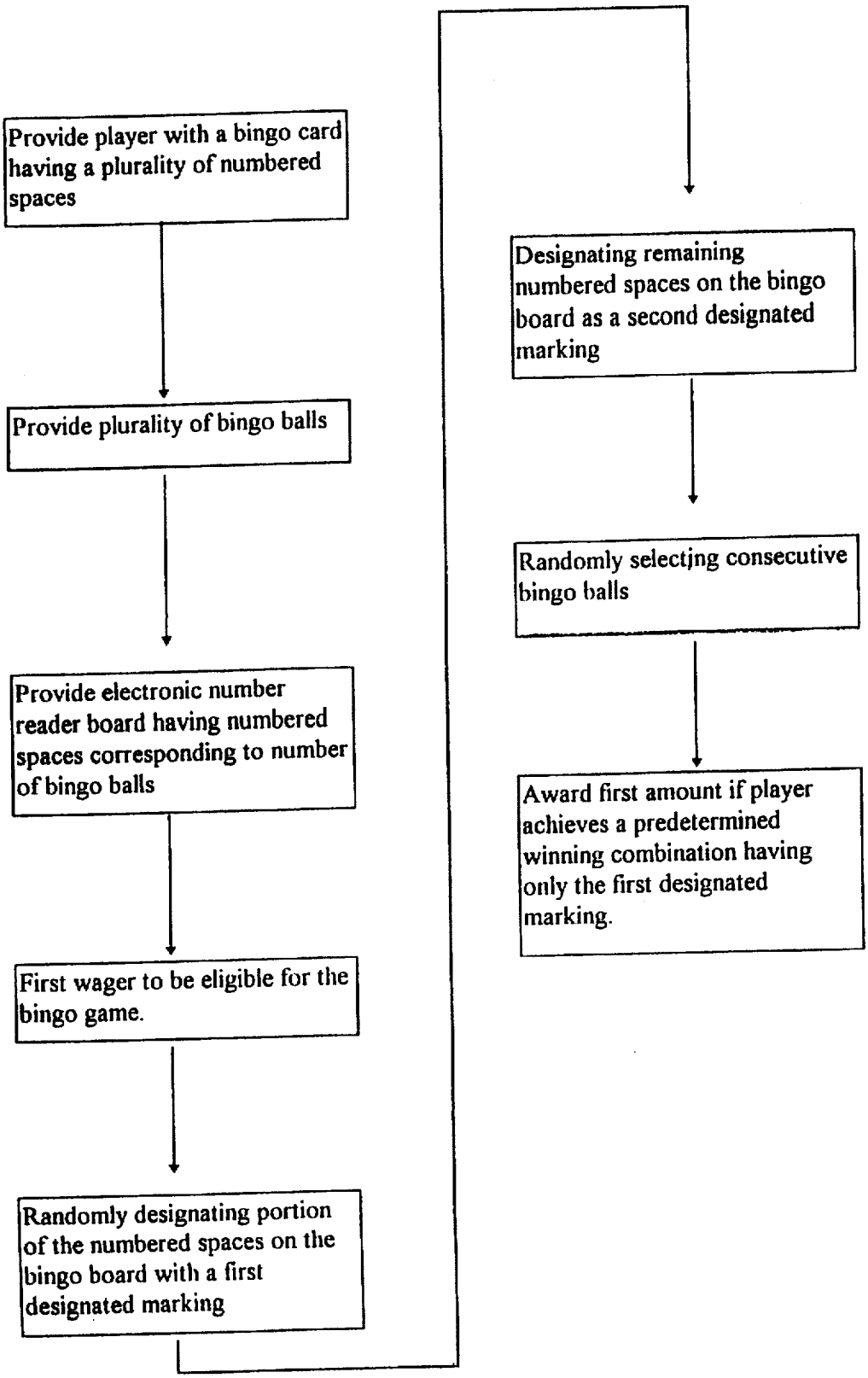
FIG. 7 shows a flow chart depicting a method of play of the present invention.

FIG. 7 shows a flow chart that graphically depicts a method of play of a preferred embodiment of the present invention. As shown in FIG. 7, the player is provided with a bingo card having a plurality of numbered spaces and a plurality of bingo balls are also provided. An electronic number reader board having numbered spaces corresponding to the number of bingo balls is positioned in the gaming establishment for viewing by each of the players. After a player makes a first wager to be eligible for the bingo game, the electronic control system randomly designates a portion of the numbered spaces on the bingo board with a first designated marking and the remaining numbered spaces on the bingo board have a second designated marking.

Consecutive bingo balls are then randomly selected until one of the players achieves a bingo. If the player achieves a predetermined winning combination having only the first designated marking, the player is then awarded a first amount.

Figure 8:
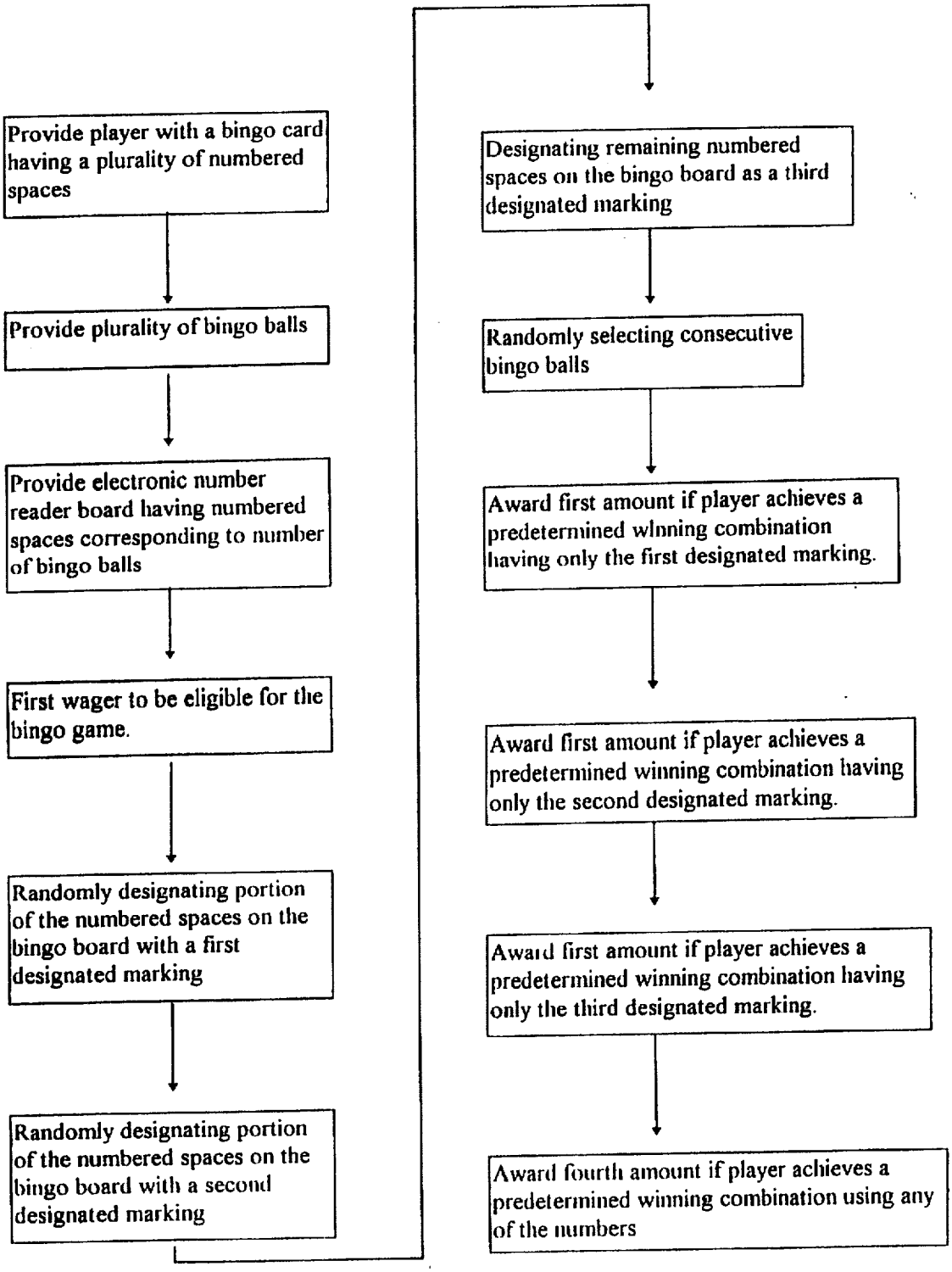
FIG. 8 shows a flow chart depicting an alternative method of play of the present invention.

FIG. 8 shows another flow chart that graphically depicts another method of play of a preferred embodiment of the present invention. As shown in FIG. 8, the player is provided with a bingo card having a plurality of numbered spaces and a plurality of bingo balls are also provided. An electronic number reader board having numbered spaces corresponding to the number of bingo balls is positioned in the gaming establishment for viewing by each of the players. After a player makes a first wager to be eligible for the bingo game, the electronic control system randomly designates a portion of the numbered spaces on the bingo board with a first designated marking and a second designated marking. The remaining numbered spaces on the bingo board have a third designated marking.

Consecutive bingo balls are then randomly selected until one of the players achieves a bingo. If the player achieves a predetermined winning combination having only the first designated marking, the player is then awarded a first amount. If the player achieves a predetermined winning combination having only the second designated marking, the player is then awarded a second amount. If the player achieves a predetermined winning combination having only the third designated marking, the player is then awarded a third amount. If the player achieves a predetermined winning combination having any combination of the designated markings, the player is then awarded a fourth amount.

Figure 9:
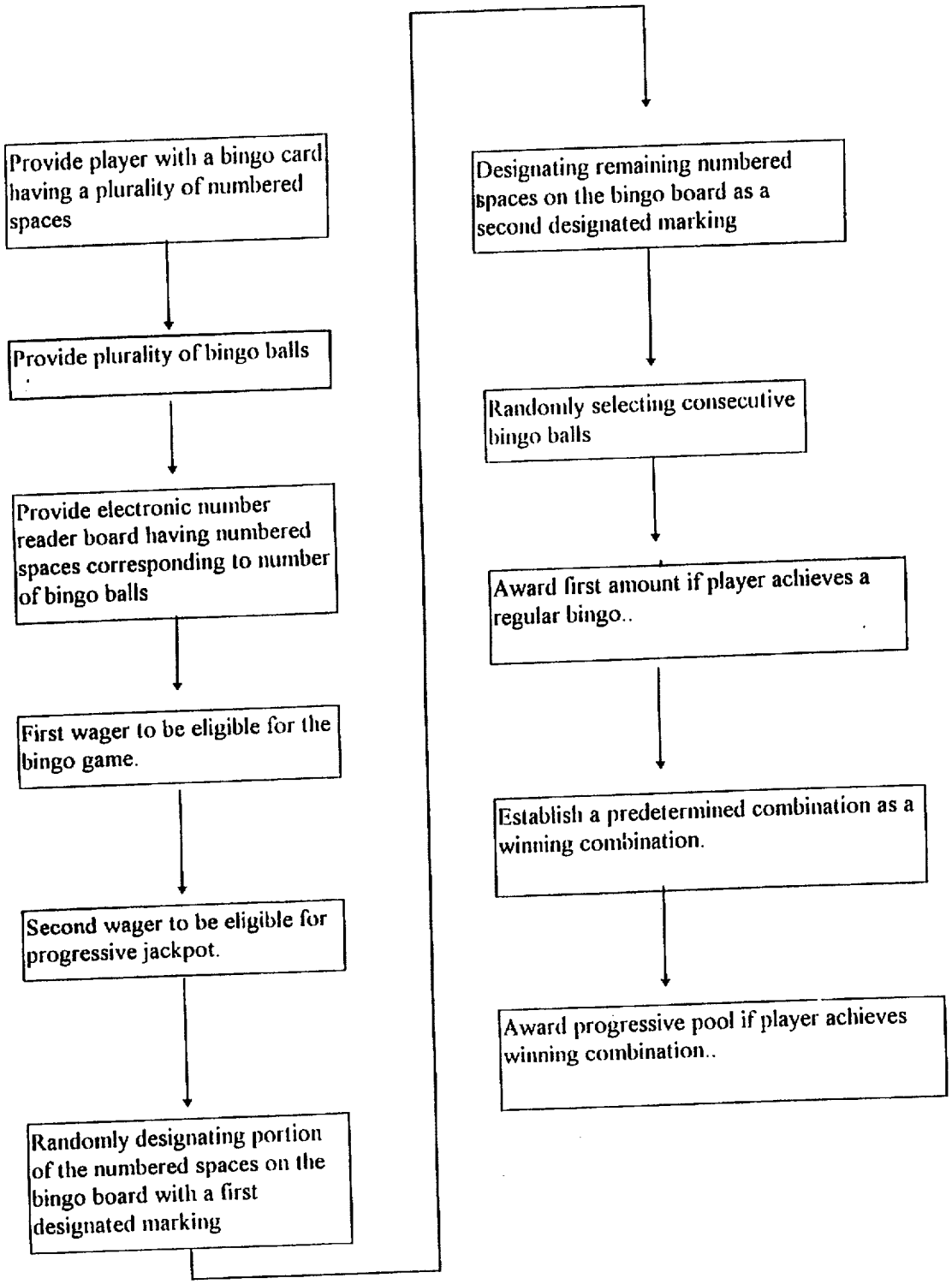
FIG. 9 shows a flow chart depicting another alternative method of play of the present invention.

FIG. 9 shows another flow chart that graphically depicts another method of play of a preferred embodiment of the present invention. As shown in FIG. 9, the player is provided with a bingo card having a plurality of numbered spaces and a plurality of bingo balls are also provided. An electronic number reader board having numbered spaces corresponding to the number of bingo balls is positioned in the gaming establishment for viewing by each of the players. A player makes a first wager to be eligible for the bingo game and a second wager to be eligible for progressive jackpot payouts. Then the electronic control system randomly designates a portion of the numbered spaces on the bingo board with a first designated marking and the remaining numbered spaces on the bingo board have a second designated marking.

Consecutive bingo balls are then randomly selected until one of the players achieves a bingo. If the player achieves a regular bingo, the player is paid a first amount. Also, if the player achieves a predetermined winning combination, the player is then awarded all or a portion of the progressive pool.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. The method of playing a game of bingo comprising:

a) providing a player with a bingo card having a plurality of numbered spaces;

b) providing a plurality of bingo balls each having individual numbers corresponding to the numbered spaces on the bingo card;

c) providing an electronic number reader bingo board having a plurality of numbered spaces corresponding to the number of bingo balls used in the bingo game;

d) a player making a wager to be eligible for the bingo game;

e) randomly designating a portion of the numbered spaces on the bingo board with a first designated marking;

f) designating the remaining numbered spaces on the bingo board as a second designated marking;

g) randomly selecting consecutive bingo balls;

h) if the player achieves a predetermined winning combination on the bingo card of selected numbers having only the first designated marking, awarding the player a first preselected amount.

2. The method of claim 1 further including if the player achieves a predetermined winning combination on the bingo card of selected numbers having only the second designated marking, awarding the player a second preselected amount.

3. The method of claim 1 in which if the player achieves a predetermined winning combination on the bingo card of selected numbers having both the first designated marking and the second designated marking, awarding the player a third preselected amount.

4. The method of claim 1 in which the bingo card is provided with a five-by-five matrix of numbers.

5. The method of claim 1 in which the bingo card is provided with three numbers.

6. The method of claim 1 in which the bingo card is provided with five numbers.

7. The method of claim 1 in which a portion of the wager is allocated to a progressive pool and the player is awarded a predetermined amount of the progressive pool for achieving a predetermined winning combination.

8. The method of claim 1 in which a portion of the wager is allocated to a first progressive pool and the first preselected amount is a predetermined amount of the first progressive pool and a portion of the wager is allocated to a second progressive pool and the second preselected amount is a predetermined amount of the second progressive pool.

9. The method of claim 1 further including allocating a portion of the wager to a jackpot payout pool and awarding the player a preselected amount of the jackpot payout pool if the player achieves a case bingo on the bingo card.

10. The method of claim 1 further including awarding the player a preselected amount if the player achieves a case bingo on the bingo card.

11. The method of playing a game of bingo comprising:

a) providing a player with a bingo card having a plurality of numbered spaces;

b) providing a plurality of bingo balls each having individual numbers corresponding to the numbered spaces on the bingo card;

c) providing an electronic number reader bingo board having a plurality of numbered spaces corresponding to the number of bingo balls used in the bingo game;

d) a player making a wager to be eligible for the bingo game;

e) randomly designating a portion of the numbered spaces on the bingo board with a first designated marking;

f) randomly designating a portion of the numbered spaces on the bingo board with a second designated marking;

g) designating the remaining numbered spaces on the bingo board as a third designated marking;

h) randomly selecting consecutive bingo balls;

i) if the player achieves a predetermined winning combination on the bingo card of selected numbers having only the first designated marking, awarding the player a first preselected amount;

j) if the player achieves a predetermined winning combination on the bingo card of selected numbers having only the second designated marking, awarding the player a second preselected amount;

k) if the player achieves a predetermined winning combination on the bingo card of selected numbers having only the third designated marking, awarding the player a third preselected amount; and l) if the player achieves a predetermined winning combination on the bingo card of selected numbers combining the first designated marking, the second designated marking or the third designated marking, awarding the player a fourth preselected amount.

12. The method of claim 11 in which a portion of the wager is allocated to a first progressive pool and the first preselected amount is a predetermined amount of the first progressive pool, a portion of the wager is allocated to a second progressive pool and the second preselected amount is a predetermined amount of the second progressive pool and a portion of the wager is allocated to a third progressive pool and the third preselected amount is a predetermined amount of the third progressive pool.

13. The method of claim 11 further including allocating a portion of the wager to a jackpot payout pool and awarding the player a preselected amount of the jackpot payout pool if the player achieves a case bingo on the bingo card.

14. The method of claim 11 further including awarding the player a preselected amount if the player achieves a case bingo on the bingo card.

15. The method of playing a game of bingo comprising:

a) providing a player with a bingo card having a plurality of numbered spaces;

b) providing a plurality of bingo balls each having individual numbers corresponding to the numbered spaces on the bingo card;

c) providing an electronic number reader board having a plurality of numbered spaces corresponding to the number of bingo balls used in the bingo game;

d) a player making a wager to be eligible for the bingo game;

e) randomly designating a portion of the numbered spaces on the bingo board with a first designated marking;

f) randomly designating a portion of the numbered spaces on the bingo board with a second designated marking;

g) randomly designating a portion of the numbered spaces on the bingo board with a third designated marking;

h) designating the remaining numbered spaces on the bingo board as a fourth designated marking;

i) randomly selecting consecutive bingo balls;

j) if the player achieves a predetermined winning combination on the bingo card of selected numbers having only the first designated marking, awarding the player a first preselected amount;

k) if the player achieves a predetermined winning combination on the bingo card of selected numbers having only the second designated marking, awarding the player a second preselected amount;

l) if the player achieves a predetermined winning combination on the bingo card of selected numbers having only the third designated marking, awarding the player a third preselected amount;

m) if the player achieves a predetermined winning combination on the bingo card of selected numbers having only the fourth designated marking, awarding the player a fourth preselected amount; and n) if the player achieves a predetermined winning combination on the bingo card of selected numbers combining the first designated marking, the second designated marking, the third designated marking or the fourth designated marking, awarding the player a fifth preselected amount.

16. The method of claim 15 in which a portion of the wager is allocated to a first progressive pool and the first preselected amount is a predetermined amount of the first progressive pool, a portion of the wager is allocated to a second progressive pool and the second preselected amount is a predetermined amount of the second progressive pool, a portion of the wager is allocated to a third progressive pool and the third preselected amount is a predetermined amount of the third progressive pool and a portion of the wager is allocated to a fourth progressive pool and the fourth preselected amount is a predetermined portion of the fourth progressive pool.

17. The method of claim 15 further including allocating a portion of the wager to a jackpot payout pool and awarding the player a preselected amount of the jackpot payout pool if the player achieves a case bingo on the bingo card.

18. The method of claim 15 further including awarding the player a preselected amount if the player achieves a case bingo on the bingo card.

19. The method of playing a game of bingo comprising:

a) providing a player with a bingo card having a plurality of numbered spaces;

b) providing a plurality of bingo balls each having individual numbers corresponding to the numbered spaces on the bingo card;

c) providing an electronic number reader bingo board having a plurality of numbered spaces corresponding to the number of bingo balls used in the bingo game;

d) a player making a first wager to be eligible for the bingo game, e) a player making a second wager to be eligible for a progressive jackpot;

f) randomly designating a portion of the numbered spaces on the bingo board with a first designated marking;

g) designating the remaining numbered spaces on the bingo board as a second designated marking;

h) randomly selecting consecutive bingo balls;

I) awarding an amount when the player achieves a regular winning bingo combination on the bingo card;

j) designating a portion of the second wager to a first progressive pool;

k) establishing a first predetermined combination as a winning combination for the first progressive pool; and l) awarding a portion of the first progressive pool to the player when he achieves the first predetermined winning combination.

20. The method of claim 19 in which the first predetermined combination comprises selected numbers having only the first designated marking.

21. The method of claim 19 in which the bingo card is provided with a five-by-five matrix of numbers.

22. The method of claim 19 in which the bingo card is provided with three numbers.

23. The method of claim 19 in which the bingo card is provided with five numbers.

24. The method of claim 19 further comprising:

a) designating a portion of the second wager to a second progressive pool;

b) establishing a second predetermined combination as a winning combination for the second progressive pool; and c) awarding a portion of the second progressive pool to the player when he achieves the second predetermined winning combination.

25. The method of claim 24 in which the second predetermined combination comprises selected numbers having only the second designated marking.

26. The method of claim 19 further including allocating a portion of the second wager to a jackpot payout pool and awarding the player a preselected amount of the jackpot payout pool if the player achieves a case bingo on the bingo card.

27. The method of claim 19 further including awarding the player a preselected amount if the player achieves a case bingo on the bingo card.

28. The method of playing a game of bingo comprising:

a) providing a player with a bingo card having a plurality of numbered spaces;

b) providing a plurality of bingo balls each having individual numbers corresponding to the numbered spaces on the bingo card;

c) providing an electronic number reader bingo board having a plurality of numbered spaces corresponding to the number of bingo balls used in the bingo game;

d) a player making a first wager to be eligible for the bingo game, e) a player making a second wager to be eligible for a progressive jackpot;

f) randomly designating a portion of the numbered spaces on the bingo board with a first designated marking;

g) randomly designating a portion of the numbered spaces on the bingo board with a second designated marking;

h) designating the remaining numbered spaces on the bingo board as a third designated marking;

I) randomly selecting consecutive bingo balls;

j) awarding an amount when the player achieves a regular winning bingo combination on the bingo card;

k) designating a portion of the second wager to a first progressive pool;

l) designating a portion of the second wager to a second progressive pool;

m) establishing a first predetermined combination as a winning combination for the first progressive pool;

n) establishing a second predetermined combination as a winning combination for the second progressive pool;

o) awarding a portion of the first progressive pool to the player when he achieves the first predetermined winning combination; and p) awarding a portion of the second progressive pool to the player when he achieves the second predetermined winning combination.

29. The method of claim 28 in which the first predetermined combination comprises selected numbers having only the first designated marking.

30. The method of claim 28 in which the second predetermined combination comprises selected numbers having only the second designated marking.

31. The method of claim 28 further comprising:

a) designating a portion of the second wager to a third progressive pool;

b) establishing a third predetermined combination as a winning combination for the third progressive pool; and c) awarding a portion of the third progressive pool to the player when he achieves the third predetermined winning combination.

32. The method of claim 31 in which the third predetermined combination comprises selected numbers having only the third designated marking.

33. The method of claim 28 further including allocating a portion of the second wager to a jackpot payout pool and awarding the player a preselected amount of the jackpot payout pool if the player achieves a case bingo on the bingo card.

34. The method of claim 28 further including awarding the player a preselected amount if the player achieves a case bingo on the bingo card.

35. The method of playing a game of bingo comprising:

a) providing a player with a bingo card having a plurality of numbered spaces;

b) providing a plurality of bingo balls each having individual numbers corresponding to the numbered spaces on the bingo card;

c) providing an electronic number reader bingo board having a plurality of numbered spaces corresponding to the number of bingo balls used in the bingo game;

d) a player making a first wager to be eligible for the bingo game, e) a player making a second wager to be eligible for a progressive jackpot;

f) randomly designating a portion of the numbered spaces on the bingo board with a first designated marking;

g) randomly designating a portion of the numbered spaces on the bingo board with a second designated marking;

h) randomly designating a portion of the numbered spaces on the bingo board with a third designated marking;

i) designating the remaining numbered spaces on the bingo board as a fourth designated marking;

j) randomly selecting consecutive bingo balls;

k) awarding an amount when the player achieves a regular winning bingo combination on the bingo card;

l) designating a portion of the second wager to a first progressive pool;

m) designating a portion of the second wager to a second progressive pool;

n) designating a portion of the second wager to a third progressive pool;

o) designating a portion of the second wager to a fourth progressive pool;

p) establishing a first predetermined combination as a winning combination for the first progressive pool;

q) establishing a second predetermined combination as a winning combination for the second progressive pool;

r) establishing a third predetermined combination as a winning combination for the third progressive pool;

s) establishing a fourth predetermined combination as a winning combination for the fourth progressive pool;

t) awarding a portion of the first progressive pool to the player when he achieves the first predetermined winning combination;

u) awarding a portion of the second progressive pool to the player when he achieves the second predetermined winning combination;

v) awarding a portion of the third progressive pool to the player when he achieves the third predetermined winning combination; and w) awarding a portion of the fourth progressive pool to the player when he achieves the fourth predetermined winning combination.

36. The method of claim 35 in which the first predetermined combination comprises selected numbers having only the first designated marking.

37. The method of claim 35 in which the second predetermined combination comprises selected numbers having only the second designated marking.

38. The method of claim 35 in which the third predetermined combination comprises selected numbers having only the third designated marking.

39. The method of claim 35 in which the fourth predetermined combination comprises selected numbers having only the fourth designated marking.

40. The method of claim 35 further including allocating a portion of the second wager to a jackpot payout pool and awarding the player a preselected amount of the jackpot payout pool if the player achieves a case bingo on the bingo card.

41. The method of claim 35 further including awarding the player a preselected amount if the player achieves a case bingo on the bingo card.

* * * * *